United States Patent [19]

Chen

[11] Patent Number: 4,802,287

[45] Date of Patent: Feb. 7, 1989

[54] TWO-PURPOSE DEVICE OF HAND AND HAIR DRYERS

[75] Inventor: Shye L. Chen, Taipei, Taiwan

[73] Assignee: Tatung-Conair Corporation, Taipei, Taiwan

[21] Appl. No.: 97,120

[22] Filed: Sep. 16, 1987

[51] Int. Cl.[4] ..... F26B 19/00

[52] U.S. Cl. ..... 34/91; 34/97; 219/366; 219/369

[58] Field of Search ..... 34/91, 90, 96, 97; 219/359, 360, 361, 366, 367, 375, 368, 369, 370, 371, 374

[56] References Cited

U.S. PATENT DOCUMENTS

| | | | |
|---|---|---|---|
| 1,224,306 | 5/1917 | Lemp et al. | 34/90 |
| 2,698,894 | 1/1955 | Stein | 219/360 |
| 3,357,109 | 12/1967 | Harvey | 34/91 |
| 3,878,621 | 4/1975 | Duerre | 34/90 |
| 4,094,076 | 6/1978 | Baslow | 34/90 |
| 4,195,416 | 4/1980 | Hall | 34/90 |
| 4,642,909 | 2/1987 | Garcia | 34/97 |
| 4,707,933 | 11/1967 | Keck et al. | 219/366 X |

*Primary Examiner*—Steven E. Warner
*Attorney, Agent, or Firm*—Holman & Stern

[57] ABSTRACT

A dual purpose hand and hair dryer, and a cabinet for mounting the hair dryer on a wall for use as a hand dryer. The cabinet has a swing-down front part which receives the hair dryer and which has electric circuitry for operating the hair dryer including a light-sensitive switch and a timer.

3 Claims, 3 Drawing Sheets

TWO-PURPOSE DEVICE OF HAND AND HAIR DRYERS

BACKGROUND OF THE INVENTION

As currently popular used Hair Dryers or Hand Dryers are divers in body structures and various in types; however, they are limited for one purpose only, i.e., Hair Dryers are only for drying hairs, while the Hand Dryers are only for drying hands. In other words, when you want to dry your hairs or to dry your dress when it is wet, the Hand Dryer cannot help; similarly, when you want to dry your wet hands, nothing can be done by the Hair Dryer, too. Especially, the common Hand Dryers are not only large in volume and occupying more spaces, but also in practical use, must first press or turn a preset button or switch to operate. (The Hair Dryers are also necessary to preset with a switch.) Similarly, after using, the switch must be cut off to complete the operation. Hence, it lacks the functions of simplicity and rapidity for practical use.

The inventor of this Invention dealing with the manufacture of various electrical appliances for many years, in view of lacking a new structural design of dual purpose dryer for both hair and hand among the popularly used electrical appliances, tried hard in continuous experiments for research and renovation, and finally, by gathering the results from multiple experiments and research and accompanying with accumulated working experiences for so many years, invented a kind of Dual Purpose Dryer for Both Hair and Hand. Moreover, in operating for practical use, the hand drying can be performed by the automatic inductive control of the ultrared ray, being sanitary and safe, with high practical value.

SUMMARY OF THE INVENTION

This invention is a kind of structure of Dual Purpose Hair and Hand Dryer. The structure contains a small type removable high efficiency hair dryer hidden in the hanging box so that when in use, this invention can provide simultaneously the dual functions of drying hairs and hands. Moreover, in operating for use, the Dryer shall be performed by the automatic inductive control of the ultrared ray, unnecessary to touch any switch, being sanitary and safe, generally suitable for family and hotel uses.

BRIEF DESCRIPTION OF THE DRAWINGS

FIG. I—the three-dimentional outlook diagram of this invention

FIG. II—the analytical diagram of this invention

Figure 1:
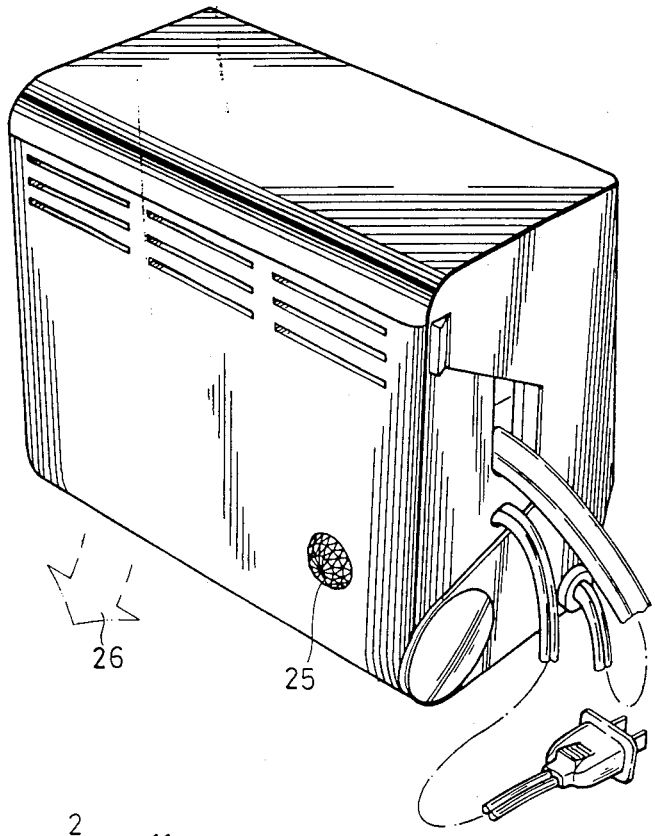
Figure 3:
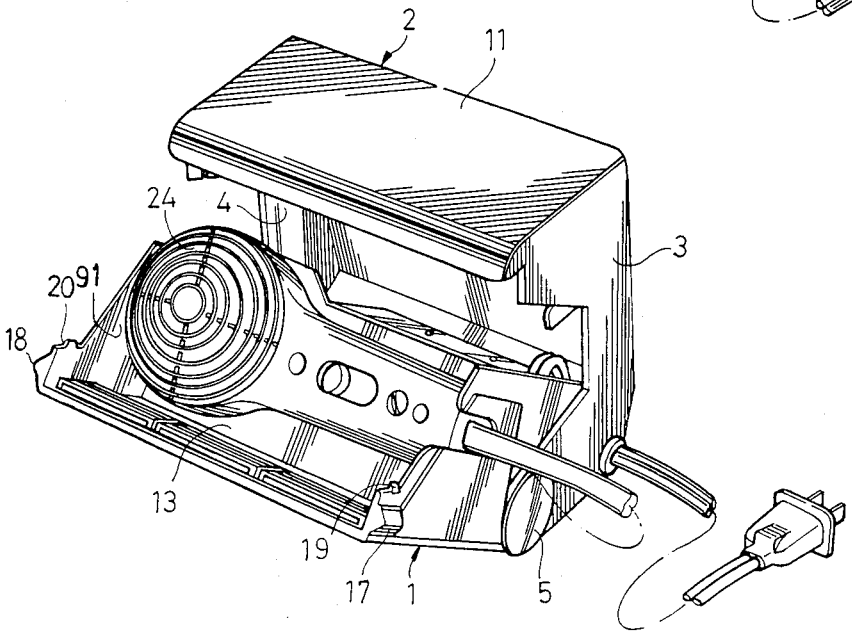
Figure 2:
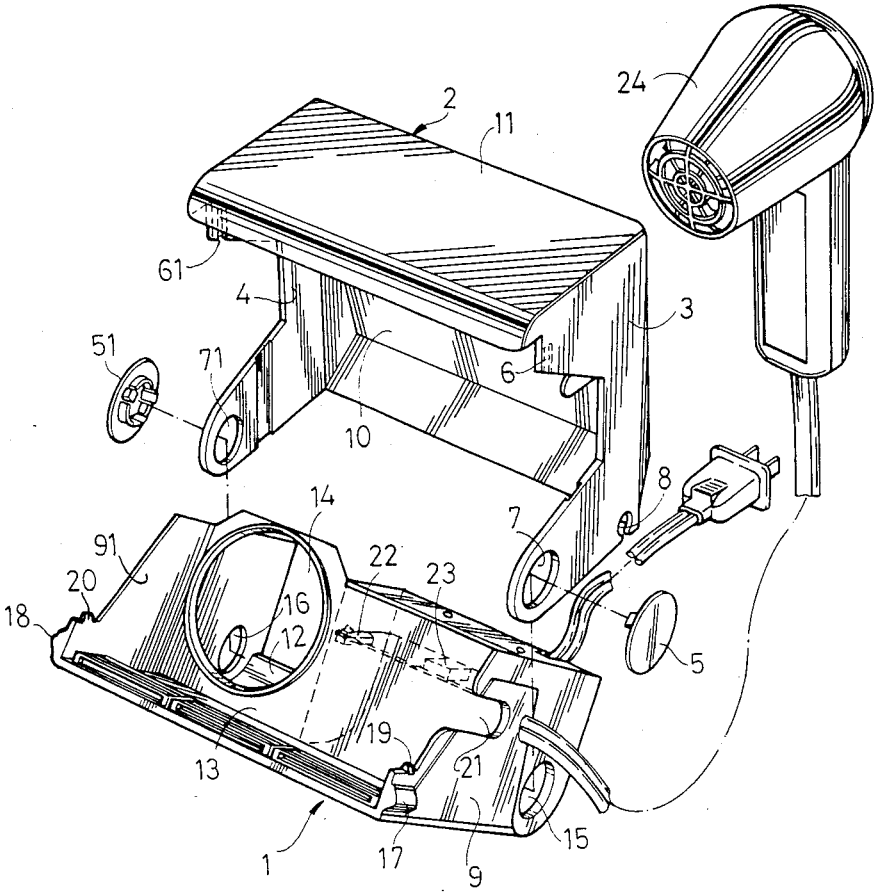
Figure 4:
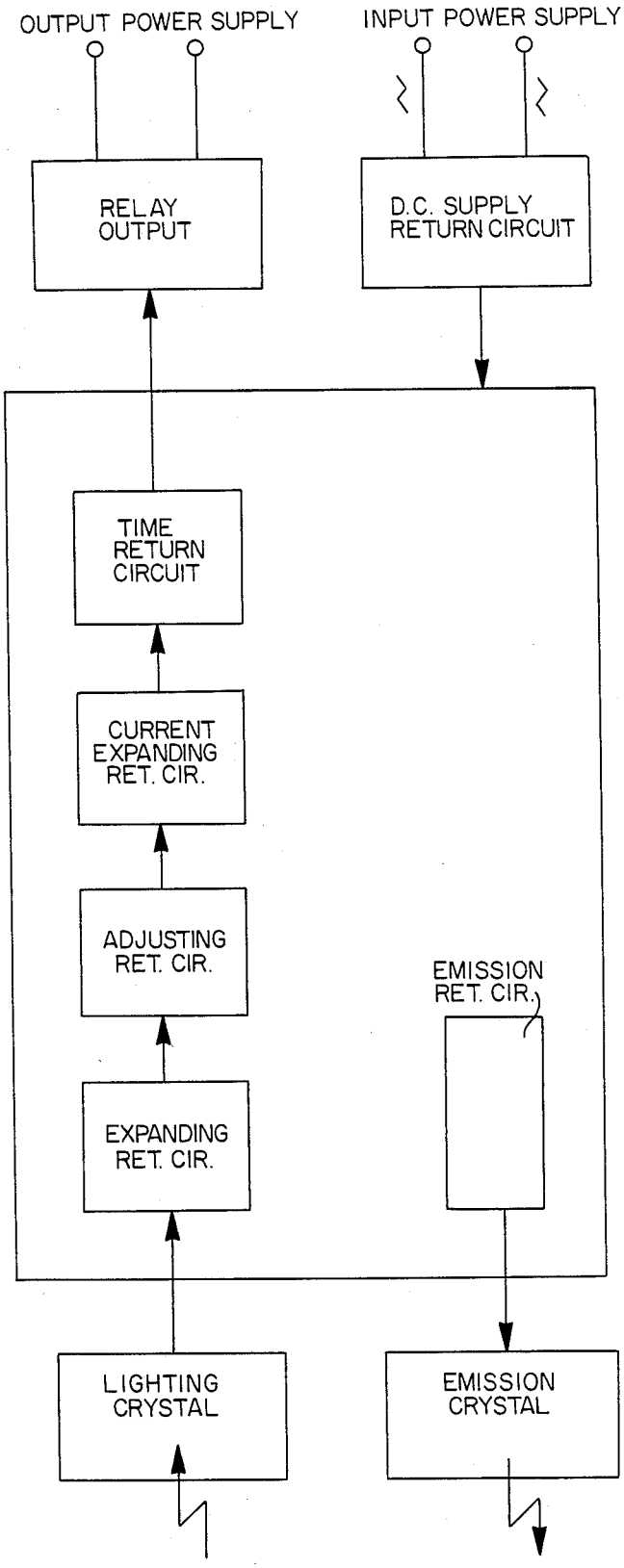

FIG. III—the schematic diagram of this invention

FIG. IV—the practical electric circuit diagram for this invention

DESCRIPTION OF THE PREFERRED EMBODIMENT

For providing a further understanding to the structure and functions of this invention, detailed descriptions matched to the attached drawings are given below:

Referring to the FIGS. I and II, the structure of this invention is consisted of a Base Body or front part (1) of the device for containing the accesories and a Hanging Box Body or base part (2). The Hanging Box Body has two Arms Braces (3) and (4) in the shape of "]" at its two terminal sides respectively; and a Bottom End Face

(10) and a Top End Face (11). Two Concave Rabbets (6) and (61) are fixed separately in the inner flange at the top front ends of the Arm Braces (3) and (4); two Holes (7) and (71) are fitted at the bottom front ends of the Arm Braces (3) and (4) respectively; and a Hole Path (8) is fitted for passing the electric wire. The Base Body (1) also has two Arm Braces (9) and (91) at its two terminal sides respectively, and a Side Face (12). Between the Arm Braces (9) and (91), a Base Face is formed; and on one side of the Base Face (13), a Hole (14) is fitted for inserting the head of the dryer. Another two Holes (15) and (16) are fixed symmetrically in the inner side at the bottom ends of the Arm Braces (9) and (91). Two Pintle Retainers (5) and (51) are used to insert into the Pintle Holes (15) and (16) and (7) and (71) so that the Base Body (1) and Hanging Box Body (2) to lock up to become a combination which can slew freely on the pintle pivot. Besides, on the outer flange near the inside of the bottom ends of the two Arm Braces (9) and (91), separately fitted with a pair of Convex Wave Pattern Surfaces (17) and (18) and two elastic Caliper Tenon Hooks (19) and (20) for the convenience of hand holding. Again, in the central position of the Arm Brace (9) on the same side of the elastic Caliper Tenon Hook (19), a notch of Concave Groove (21) is opened for passing the electric wire connecting to the tail part of the dryer. There are several perpendicular side surface set on the bottom end of the Base Face (13), with a Microswitch (22) and a Time Controller (23) fixed on it. And, a Sensor Switch (25) is fixed on the Side Face (12) of the Base Body (1); under the control of this Sensor Switch, even when the dryer is taken out of the Base Body (1) and the Microswitch (22) is in the "ON" position, the dryer can be used for hair drying or other "blowing to dry" purposes, and when the cover-opened Dryer (24) is placed back on the Base Body (1), the Microswitch (22) will be pressed from the top to turn to the "OFF" position.

In regard to the practical condition in using this invention, please refer to the diagrams indicated in the attached drawings. When this invention is used for hand drying (as shown in Fig. I), once the hands reach to the Outlet (26), the Sensor Switch (25) will immediately be induced and automatically start to operate, thus push the hot wind to blow out from the Outlet (26). And, when the current is connected, the Time Controller (23) will control the time to be 90 seconds; after 90 seconds, the power source will be automatically cut off. The control of power source is shown by the Circuit Route Diagram given in FIG. IV. When this invention is used for hair drying or other drying purposes, just use your hands to press the Concave Wave Pattern Surfaces (17) and (18) on two end sides of the Base Body (1) so that the elastic Caliper Tenon Hooks (19) and (20) will be disengaged from the Concave Rabbets (6) and (61) on the Hanging Box Body (2), thus the Hanging Box Body (2) will slew downward, forming an angle of 60° opening so that the dryer can be removed from the whole body and individually used for hair drying and other drying purposes.

Therefore, it is understood that the primary objective of this invention is intended to provide a Dual Purpose Hair and Hand Dryer. Beyond its function of hand drying, the structure design of this invention enables the performance of its another function of hair drying by pressing open the Hanging Box Body to take out the dryer.

The subsidiary objective of this invention is that the performance of its hand drying function is controlled by fully automatic inductive ultrared ray, unnecessary to touch any switch, being sanitary and safe.

The another objective of this invention is to utilize its structure of small volume, light weight and being easily installed, hence suitable for family and hotel uses.

In recapitulation, it is apparent that the structure under this case has the aforesaid excellent characteristics, with unprecedented conventional functions improved in its operations and further giving it the practicality. It is really a very good design structure for products with practical values. Again, all the characteristics mentioned above are only those more easily applied practical examples of this invention, but they are not used to limit this invention; since it is possible for all people who are familiar with such techniques may make effectual changes from this invention to be adaptable for other applications, hence all such variations within the scope of this invention shall all be included within the range of the patent rights of this Invention.

I claim:

1. A combination hair and hand dryer device comprising a portable hand-held electric hair dryer and a cabinet for mounting the hair dryer on a wall or the like so as to convert same to a hand dryer, the cabinet comprising a base part with a base wall, side arms extending from the base wall, and a top cover, the cabinet further comprising a front part having side walls, a front wall with a vent, and internal means for releasably securing the hair dryer therein in a position to blow heated air through the vent, the cabinet still further comprising pivot means connecting the side walls to the side arms for swinging the front part between open and closed positions relative to the base part, for insertion and removal or the hair dryer in the open position and operation of the device as a hand dryer in the closed position, and catch means on the front part and base part for releasably retaining the front part in the closed position.

2. A device as claimed in claim 1 wherein the front part includes electric circuit means for operating the hair dryer when the front part is in the closed position, the circuit means including a light-sensitive switch on an exterior surface of said front wall adjacent the vent for initiating operation of the hair dryer.

3. A device as claimed in claim 2 wherein the circuit means includes a timer means for terminating operation of the hair dryer after a predetermined time period of operation.

* * * * *